US011252996B2

(12) United States Patent
Rivera

(10) Patent No.: US 11,252,996 B2
(45) Date of Patent: Feb. 22, 2022

(54) CIGAR TOOL

(71) Applicant: Adrian Rivera, Whittier, CA (US)

(72) Inventor: Adrian Rivera, Whittier, CA (US)

( * ) Notice: Subject to any disclaimer, the term of this patent is extended or adjusted under 35 U.S.C. 154(b) by 543 days.

(21) Appl. No.: 15/805,702

(22) Filed: Nov. 7, 2017

(65) Prior Publication Data

US 2018/0132524 A1 May 17, 2018

Related U.S. Application Data

(60) Provisional application No. 62/421,050, filed on Nov. 11, 2016.

(51) Int. Cl.
*A24F 13/26* (2006.01)

(52) U.S. Cl.
CPC ..... *A24F 13/26* (2013.01)

(58) Field of Classification Search
CPC ..... A24F 13/24; A24F 13/26; A61M 5/3202
USPC ..... 131/188, 189, 350, 253
See application file for complete search history.

(56) References Cited

U.S. PATENT DOCUMENTS 1,167,184 A * 1/1916 Knuntila ..... A24F 13/08 131/188
1,734,620 A * 11/1929 Giacopini ..... A24F 13/26 131/255
4,863,435 A * 9/1989 Sturman ..... A61M 5/3243 604/198
5,057,087 A * 10/1991 Harmon ..... A61M 5/3243 604/110
5,106,379 A * 4/1992 Leap ..... A61M 5/3271 604/198
5,681,291 A * 10/1997 Galli ..... A61M 5/2033 604/156
5,738,117 A * 4/1998 Fontaine, Jr. ..... A24F 13/26 131/249
5,862,808 A * 1/1999 Albarello ..... A24F 13/26 131/248
9,931,467 B2 * 4/2018 Fabien ..... A61M 5/2033
2002/0004649 A1 * 1/2002 Jansen ..... A61M 5/326 604/198
2004/0236283 A1 * 11/2004 Tang ..... A61M 5/322 604/197
2005/0257797 A1 * 11/2005 Taylor ..... A24F 13/26 131/248
2015/0202366 A1 * 7/2015 Henderson ..... A61M 5/31583 604/137
2018/0193562 A1 * 7/2018 Gibson ..... A61M 5/20

OTHER PUBLICATIONS

Cigar Forums, The Final Solution for a Tight Draw, 2008, Online Forum (Year: 2009).*

* cited by examiner

*Primary Examiner* — Eric Yaary
*Assistant Examiner* — Russell E Sparks
(74) *Attorney, Agent, or Firm* — IP Strategies

(57) ABSTRACT

A cigar tool includes a piercing rod, a handle, and a cover attachable over the piercing rod. The piercing rod is pointed to penetrate a densely packed cigar. The handle includes a fixed portion and a sliding portion, and squeezing the fixed and sliding portions together releases the cover exposing the piercing rod. The cover may be a simple cylindrical key fob or an added feature of a cigar lighter or ash try.

19 Claims, 4 Drawing Sheets

CIGAR TOOL

CROSS-REFERENCE TO RELATED APPLICATIONS

The present application claims the priority of U.S. Provisional Patent Application Ser. No. 62/421,050 filed Nov. 11, 2016, which application is incorporated in its entirety herein by reference.

BACKGROUND OF THE INVENTION

The present invention relates to cigar smoking and in particular to a tool for piercing a cigar.

Some cigars are provided with densely packed tobacco leaves. It can be difficult to draw through the cigar without first creating a passage through the cigar. Cigar tools for making such a passage are known, but often expose a sharp end, or do not adequately prevent the sharp end from becoming unintentionally exposed.

BRIEF SUMMARY OF THE INVENTION

The present invention addresses the above and other needs by providing a cigar tool including a piercing rod, a handle, and a cover attachable over the piercing rod. The piercing rod is pointed to penetrate a densely packed cigar. The handle includes a fixed portion and a sliding portion, and squeezing the fixed and sliding portions together releases the cover exposing the piercing rod. The cover may be a simple cylindrical key fob or an added feature of a cigar lighter or ash try.

In accordance with one aspect of the invention, there is provided a method for piercing a densely packed cigar. The method includes squeezing a sliding portion and a fixed portion of a cigar tool together, removing the piercer cover from over a piercer, and piercing a draw end of the cigar. The cigar tool includes a handle including a fixed portion and the sliding portion slidably engaging the fixed portion. The sliding portion includes a spring biasing the sliding portion away from the fixed portion, the piercer fixedly engaging the fixed portion of the handle and having an exposed portion extending through the sliding portion of the handle, an external ball recess in the piercer, and a ball passage through the sliding portion, the passage alignable with the external ball recess in the piercer. A piercer cover has an internal cavity slidable over the sliding portion to cover the piercer and an internal ball recess in the internal cavity of the piercer cover. At least one ball configured to slide radially in the ball passage. In a first sliding portion position, the sliding portion is biased away from the fixed portion by the spring and the ball passage is aligned with the internal ball recess and the ball passage is not aligned with the external ball recess of the piercer and the piercer cover is held on the sliding portion and over the piercer. In a second sliding portion position, sliding portion is pressed against the fixed portion and the ball passage through the sliding portion is aligned with the external ball recess of the piercer and the ball passage is not aligned with the internal ball recess in the piercer cover and the piercer cover is released. The piercer cover includes a cutting edge, and the method further including using the cutting edge to open a lit end of the cigar for lighting.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1:
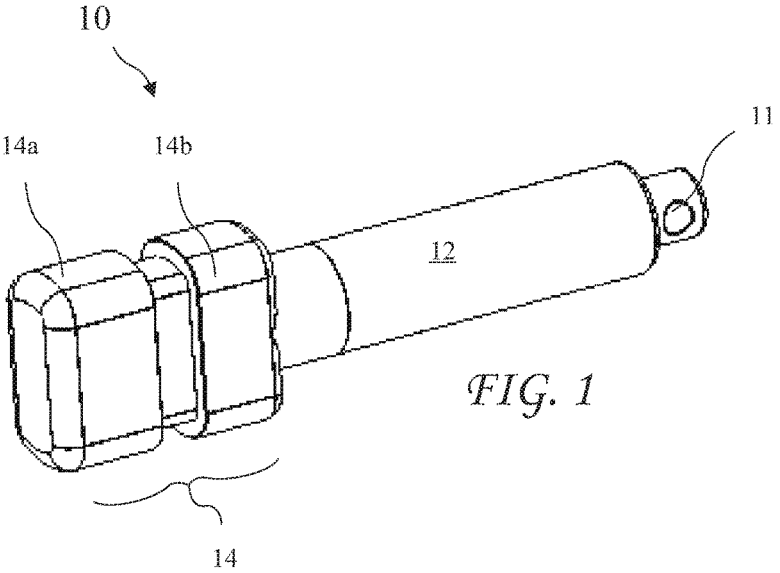
FIG. 1 is an isometric view of a cigar tool according to the present invention.
Figure 2B:
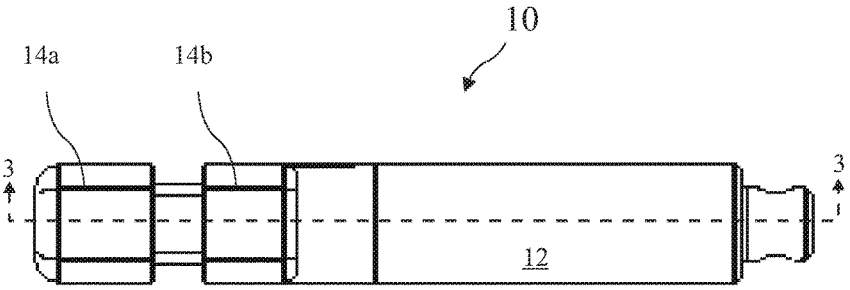
FIG. 2B is a top view of the cigar tool according to the present invention.
Figure 2D:
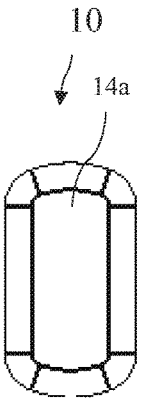
FIG. 2D is a rear view of the cigar tool according to the present invention.
Figure 2A:
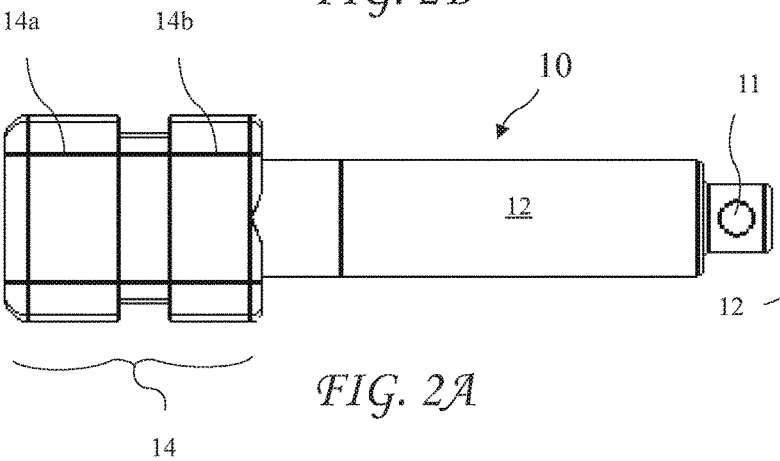
FIG. 2A is a side view of the cigar tool according to the present invention.
Figure 2C:
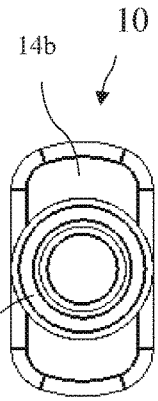
FIG. 2C is a front view of the cigar tool according to the present invention.

An isometric view of a cigar tool 10 according to the present invention is shown in FIG. 1, a side view of the cigar tool 10 is shown in FIG. 2A, a top view of the cigar tool 10 is shown in FIG. 2B, a front view of the cigar tool 10 is shown in FIG. 2C, and rear view of the cigar tool 10 is shown in FIG. 2D. The cigar tool 10 includes a handle 14 comprising a fixed portion 14*a* and a sliding portion 14*b*, and a removable piercer cover 12. The piercer cover 12 is preferably generally cylindrical and may include a key ring passage 11 allowing the cigar tool 10 to be used as a key fob. The piercer cover 12 resides over a piercer 18 (see FIG. 6).

Figure 3A:
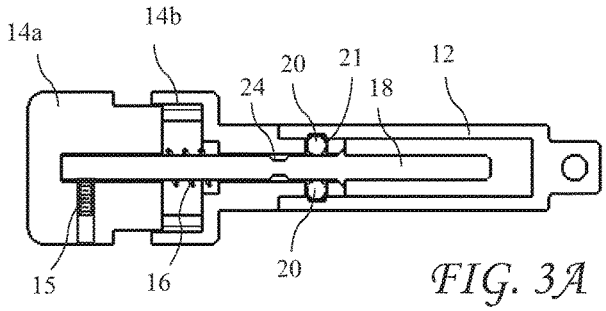
FIG. 3A is a cross-sectional view of the cigar tool according to the present invention taken long line 3-3 of FIG. 2B in a locked position.
Figure 3B:
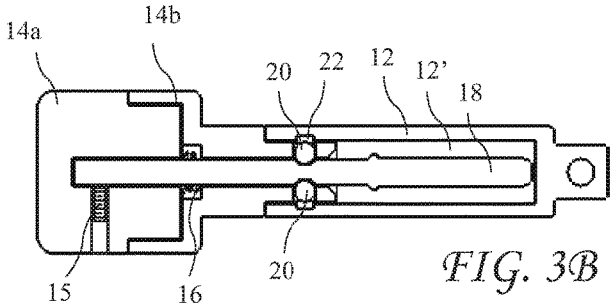
FIG. 3B is a cross-sectional view of the cigar tool according to the present invention taken long line 3-3 of FIG. 2B in an unlocked position.

A cross-sectional view of the cigar tool 10 taken long line 3-3 of FIG. 2B in a locked position is shown in FIG. 3A and a cross-sectional view of the cigar tool 10 taken long line 3-3 of FIG. 2B in an unlocked position is shown in FIG. 3B. At least detent, for example, at least one ball 20 residing in a ball passage 21 (also see FIG. 8A) of the sliding portion 14*b*. In the locked position, the ball 20 is forced by the piercer 18 to partially enter an internal ball recess 22 in a cover cavity 12*a* of the piercer cover 12, locking the piercer cover 12 onto the sliding portion 14*b*. A spring 16 biased the sliding portion 14*b* to the locked position.

In FIG. 3B, the sliding portion 14*b* is moved to the left compressing the spring 16 and aligning the ball passage 21 with a piercer ball recess 24, allowing the ball 20 to disengage from the internal ball recess 22 of the cover 12. The cover 12 is then free to be removed from the holder 14. The piercer 18 is shown attached to the fixed portion 14*a* of the handle 14, by a set screw 15, but may alternatively be attached by threads, an interference fit, adhesive, or the like. Those skilled in the art may recognize other methods of attaching the piercer 18 to the fixed portion 14, and a cigar tool including another such method is intended to come within the scope of the present invention.

Figure 4:
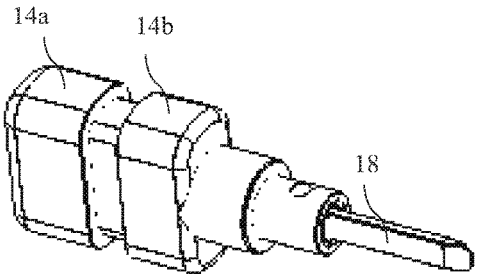
FIG. 4 is an isometric view of the cigar tool according to the present invention with a piercer cover removed.
Figure 5B:
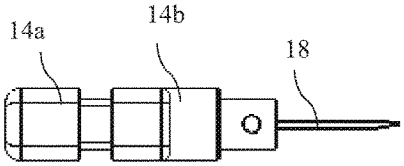
FIG. 5B is a top view of the cigar tool according to the present invention with a piercer cover removed.
Figure 5A:
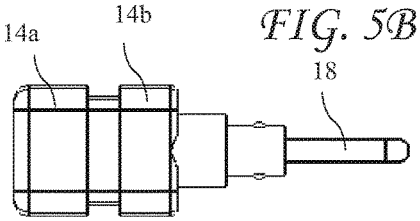
FIG. 5A is a side view of the cigar tool according to the present invention with a piercer cover removed.

An isometric view of the cigar tool 10 with the piercer cover 12 removed is shown in FIG. 4, a side view of the cigar tool 10 with the piercer cover 12 removed is shown in FIG. 5A, and a top view of the cigar tool 10 with the piercer cover 12 removed is shown in FIG. 5B. The piercer 18 is shown exposed for use.

Figure 6:
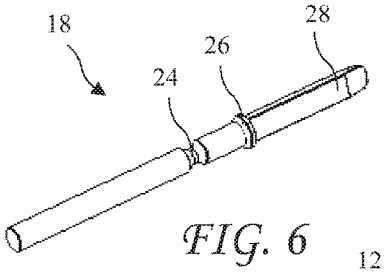
FIG. 6 is an isometric view of the piercer according to the present invention.

An isometric view of the piercer 18 is shown in FIG. 6. The piercer 18 includes the piercer ball recess 24, a piercer stop ring 26, and a piercing portion 28. The piercing portion 28 may be used to pierce a cigar end to allow a smoker to draw smoke from the cigar, or may be used to pierce the base of a cigar as a holder to avoid burning the smokers fingers as the cigar burns near the cigar end. The piercing portion 28 preferably has a square or rectangular cross-section to prevent the cigar from rotating while held by the piercer, but may have a round, oval, or other cross-section.

Figure 7:
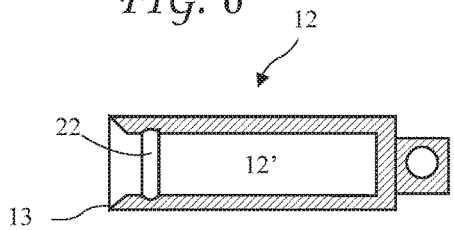
FIG. 7 is a cross-sectional view of a piercer cover according to the present invention with a cutting edge.

A cross-sectional view of the piercer cover 12 with a cutting edge 13 is shown in FIG. 7. The piercer passage 12' may be cylindrical and the internal ball recess may be an annular recess, allowing the piercer cover 12 to rotate when residing over the piercer and when engaging the handle, or the piercer passage 12' may conform to the cross-section of the piercer to angularly align the piercer cover with the piercer, or the internal ball recess may be at least one internal dimple in the passage 12', attaching the piercer cover 12 to rotationally fix the piercer cover when residing over the piercer. The cutting edge 13 allows the piercer cover 12 to be used, for example, to open the end of the cigar for lighting.

Figure 8A:
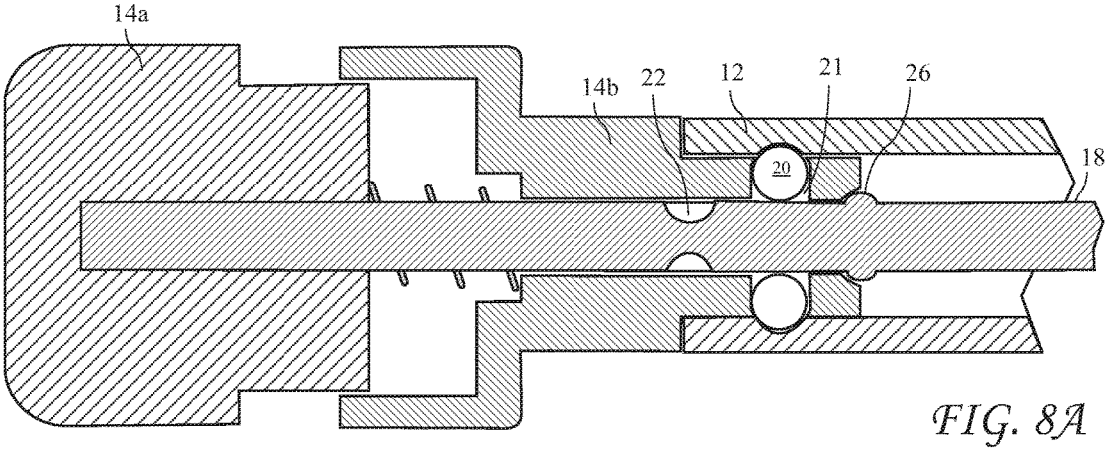
FIG. 8A shows a partial cross-sectional view of the cigar tool according to the present invention locked.
Figure 8B:
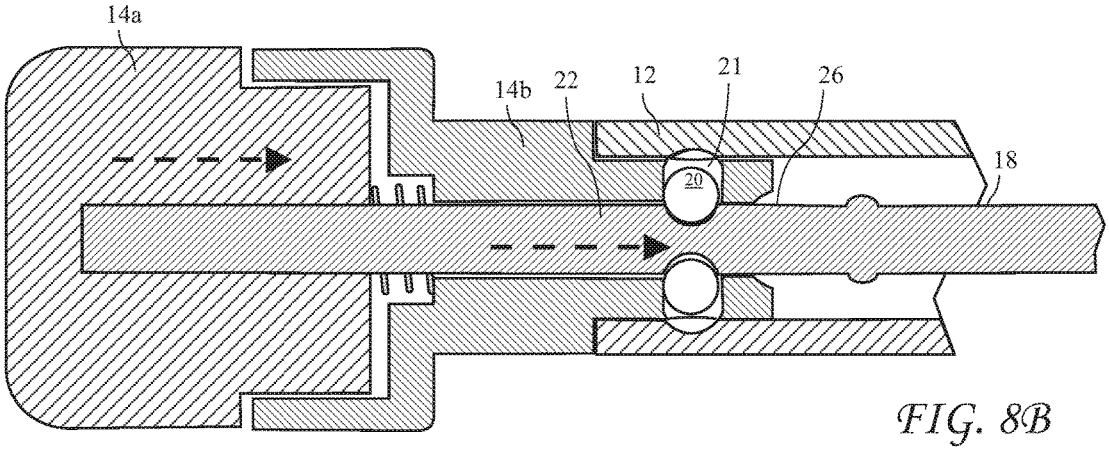
FIG. 8B shows a partial cross-sectional view of the cigar tool according to the present invention unlocked.
Figure 8C:
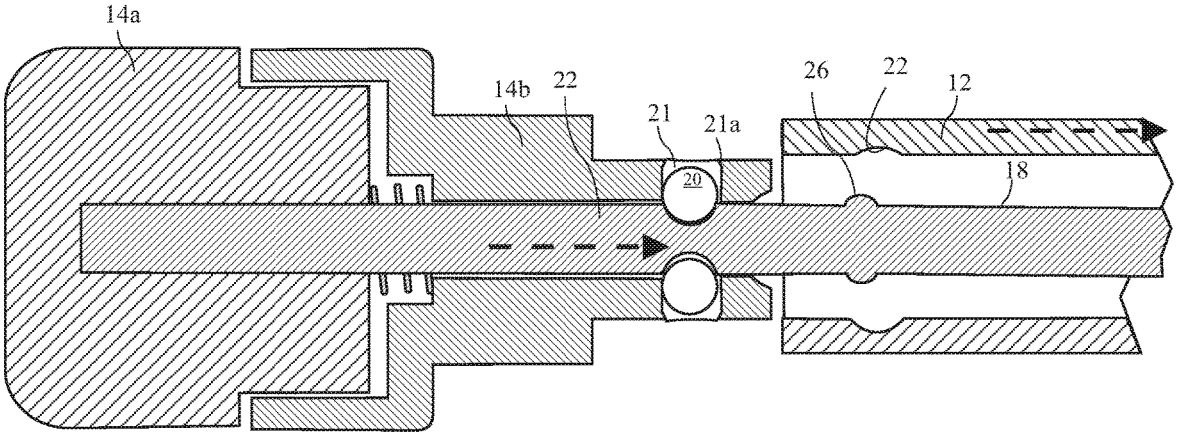
FIG. 8C shows a partial cross-sectional view of the cigar tool according to the present invention unlocked and the piercer cover partially removed.

A detailed partial cross-sectional view of the cigar tool 10 locked is shown in FIG. 8A, detailed a partial cross-sectional view of the cigar tool 10 unlocked with the piercer cover 12 in place is shown in FIG. 8B, and detailed a partial cross-sectional view of the cigar tool 10 unlocked and the piercer cover 12 partially removed is shown in FIG. 8C. Sliding the sliding portion 14*b* of the holder 12 to the left allows the balls 20 to escape the internal ball recesses 22, and the piercer cover 12 to be separated from the handle 14 exposing the piercer 18.

Figure 9:
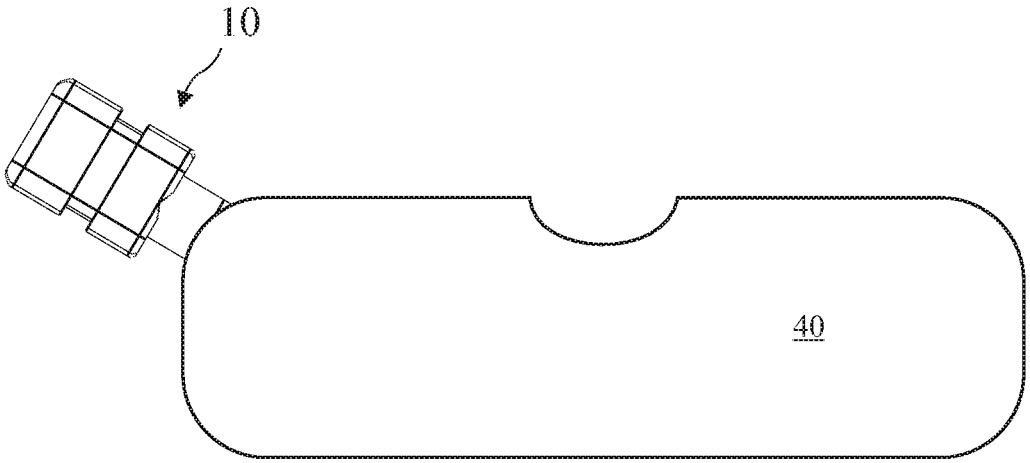
FIG. 9 shows the cigar tool according to the present invention combined with an ashtray.
Figure 10:
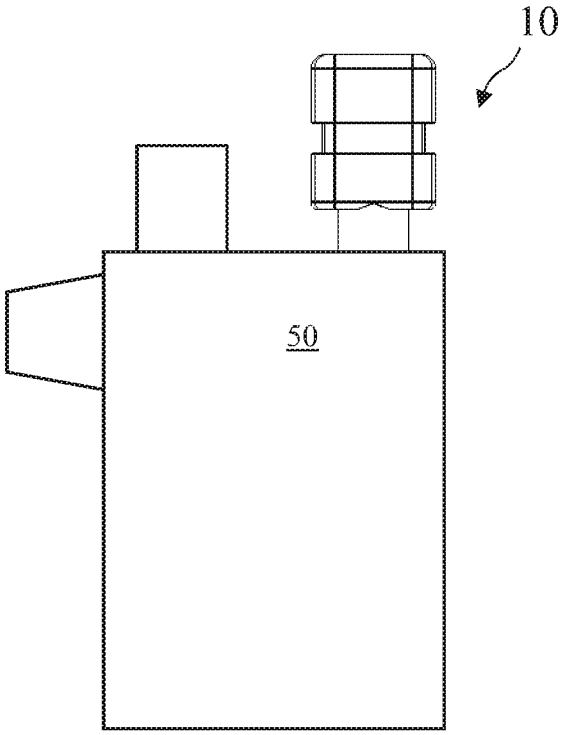
FIG. 10 shows the cigar tool according to the present invention combined with a cigar lighter.

The cigar tool 10 combined with an ashtray 40, and the cigar tool 10 combined with a cigar lighter 50 are shown in FIGS. 9 and 10. The ashtray 40 and the cigar lighter 50 replace the piercer cover 12 and includes the passage 12' shown in FIG. 7. The cigar tool 10 is attachable to and removable from the ashtray 40 and the cigar lighter 50 as shown in FIGS. 8A-8C. Those skilled in the art will recognize various other products suitable for cooperation with the cigar cutter 10, and any combination of a cigar cutter and product covering the piercer 18 as described herein is intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. A cigar tool, comprising:

a handle, including a fixed portion, and a sliding portion configured to slidingly engage the fixed portion;

a spring configured to bias the relative position of the sliding portion and the fixed portion;

a piercer attached to the fixed portion of the handle and having an exposed portion configured to extend through the sliding portion of the handle, wherein the piercer is configured to pierce through a cigar;

a piercer cover configured to slide over the piercer to engage the sliding portion and conceal a tip of the piercer; and a detent retained in the sliding portion and engaging the piercer cover;

wherein the piercer cover includes a first recess configured to engage the detent;

wherein the spring is configured to bias the sliding portion and the fixed portion in a locked position, thereby preventing the piercer cover from disengaging the sliding portion; and wherein the sliding portion is configured to be moved to overcome the spring bias in an unlocked position, thereby allowing the piercer cover to disengage from the sliding portion only in the unlocked position.

2. The cigar tool of claim 1, wherein the piercer includes a second recess and a stop ring and in the locked position, the detent and the stop ring cooperate to prevent the second recess from engaging the detent.

3. The cigar tool of claim 1, wherein the piercer includes a second recess, and the second recess is configured to engage the detent when the sliding portion is moved to overcome the spring bias in the unlocked position.

4. The cigar tool of claim 1, wherein the detent includes at least one ball.

5. The cigar tool of claim 1, wherein the sliding portion of the handle includes a passage in which the detent is arranged.

6. The cigar tool of claim 3, wherein the second recess is an annular ring.

7. The cigar tool of claim 1, wherein the sliding portion is arranged in a fixed rotational position with respect to the fixed portion.

8. The cigar tool of claim 7, wherein:

the sliding portion has a first non-round cross-section; and the fixed portion has a second non-round cross-section.

9. The cigar tool claim 1, wherein the piercer cross-section is square, rectangular, round, or oval.

10. The cigar tool of claim 9, wherein the piercer cross-section is rectangular.

11. The cigar tool of claim 10, wherein an internal cavity of the piercer cover is shaped to prevent the piercer cover from rotating with respect to the piercer.

12. The cigar tool of claim 10, wherein the piercer cross-section is not square.

13. The cigar tool of claim 1, wherein the spring is arranged around the piercer and between the fixed portion and the sliding portion.

14. The cigar tool of claim 1, wherein the piercer cover includes an opening having a cutting edge.

15. The cigar tool of claim 2, wherein the second recess is an annular ring.

16. The cigar tool of claim 1, wherein the piercer cover has a sidewall, a closed end, and an open end configured to slide over the piercer and cover the tip of the piercer.

17. The cigar tool of claim 14, wherein the cutting edge of the piercer cover abuts the sliding portion of the tool in the locked position.

18. A cigar tool, comprising:

a handle, including a fixed portion, and a sliding portion configured to slidingly engage the fixed portion;

a spring configured to bias the relative position of the sliding portion and the fixed portion;

a piercer attached to the fixed portion of the handle and having an exposed portion configured to extend through the sliding portion of the handle, wherein the piercer is configured to pierce through a cigar;

a piercer cover configured to slide over the piercer to engage the sliding portion and conceal a tip of the piercer; and a detent retained in the sliding portion and engaging the piercer cover;

wherein the piercer cover includes a first recess configured to engage the detent;

wherein the spring is configured to bias the sliding portion and the fixed portion in a locked position, thereby preventing the piercer cover from disengaging the sliding portion;

wherein the sliding portion is configured to be moved to overcome the spring bias in an unlocked position, thereby allowing the piercer cover to disengage from the sliding portion only in the unlocked position;

wherein the piercer includes a second recess and a stop ring and in the locked position, the detent and the stop ring cooperate to prevent the second recess from engaging the detent;

wherein the piercer includes a second recess, and the second recess is configured to engage the detent when the sliding portion is moved to overcome the spring bias in the unlocked position; and wherein the sliding portion of the handle includes a passage in which the detent is arranged.

19. The cigar tool of claim 18, wherein the piercer cover has a sidewall, a closed end, and an open end configured to slide over the piercer and cover the tip of the piercer.

* * * * *